United States Patent [19]

Aguilar et al.

[11] Patent Number: 5,076,884

[45] Date of Patent: Dec. 31, 1991

[54] PROCESS OF PRECIPITATING ZIRCONIUM OR HAFNIUM FROM SPENT PICKLING SOLUTIONS

[75] Inventors: Carlos L. Aguilar; Roy G. Walker, both of Ogden, Utah

[73] Assignee: Westinghouse Electric Corp., Pittsburgh, Pa.

[21] Appl. No.: 555,333

[22] Filed: Jul. 19, 1990

[51] Int. Cl.[5] ..... B44C 1/22; C23F 1/46

[52] U.S. Cl. ..... 156/642; 134/3; 134/13; 210/912; 252/79.3; 423/85; 423/488

[58] Field of Search ..... 156/642; 252/79.3; 134/3, 13; 423/484, 488, 84, 85; 210/912

[56] References Cited

U.S. PATENT DOCUMENTS

| | | | |
|---|---|---|---|
| 4,105,469 | 8/1978 | Megy et al. | 134/3 |
| 4,255,407 | 3/1981 | Puurunen | 423/484 X |
| 4,330,342 | 5/1982 | Fennemann et al. | 134/13 |
| 4,526,650 | 7/1985 | Blomquist et al. | 156/642 |
| 4,572,824 | 2/1986 | Kim | 156/642 X |
| 4,738,747 | 4/1988 | Panson | 156/642 |
| 4,927,492 | 5/1990 | Panson | 156/642 |

FOREIGN PATENT DOCUMENTS

| | | | |
|---|---|---|---|
| 706326 | 12/1979 | U.S.S.R. | 156/642 |

*Primary Examiner*—Arthur L. Corbin
*Attorney, Agent, or Firm*—J. C. Valentine

[57] ABSTRACT

A spent pickling solution containing a relatively small percentage of hydrofluoric acid and used for pickling zirconium or hafnium so as to be saturated with zirconium or hafnium fluoride, is treated by the addition thereto of sodium sulfate, $Na_2SO_4$, to precipitate sodium zirconium or hafnium fluoride. The remaining solution is recycled for further pickling use, and may have fluoride concentration increased by the addition of calcium fluoride thereto resulting in the precipitation of calcium sulfate.

4 Claims, 1 Drawing Sheet

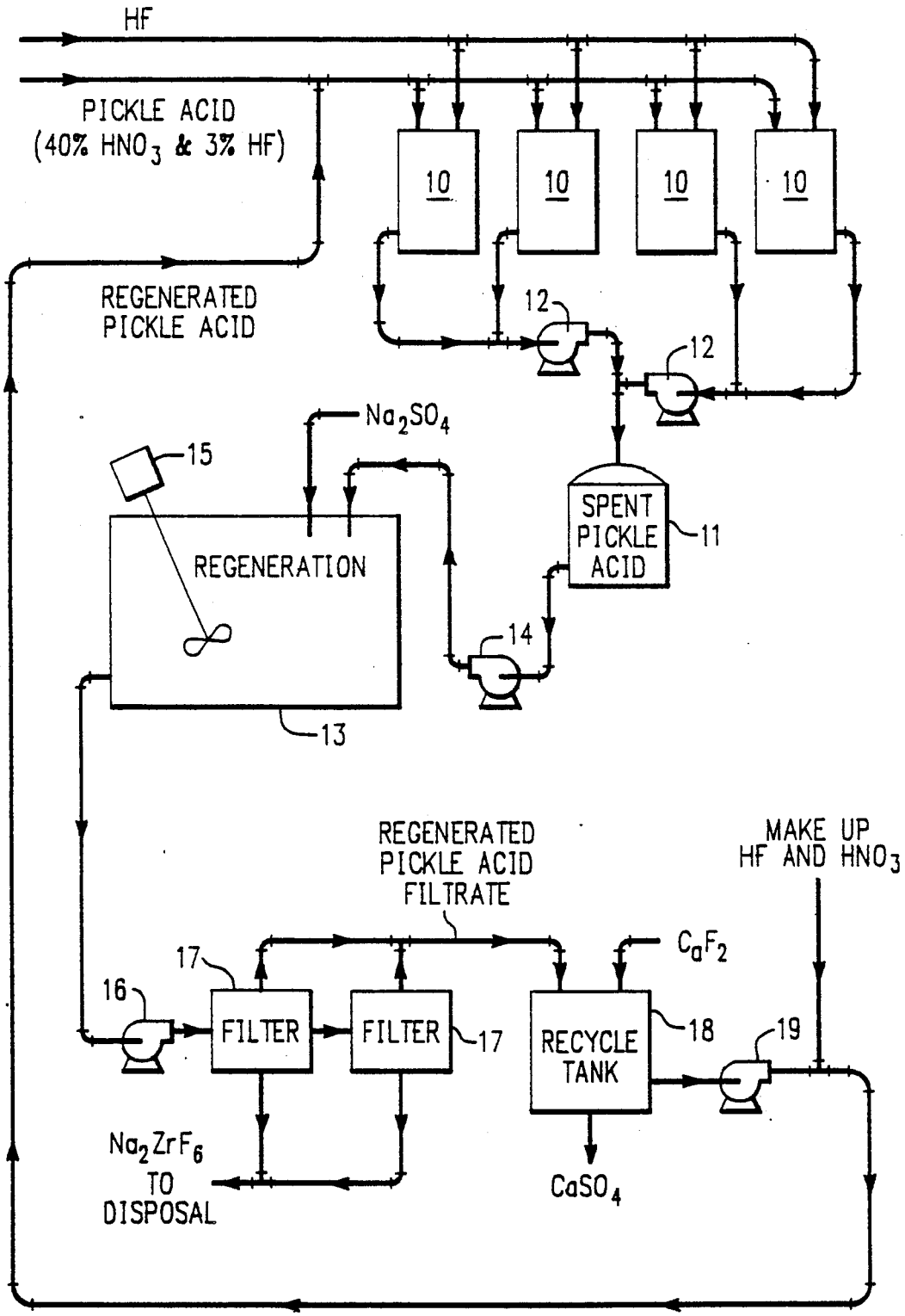
HF
PICKLE ACID
(40% $HNO_3$ & 3% HF)
10
10
10
10
REGENERATED
PICKLE ACID
12
12
$Na_2SO_4$
15
REGENERATION
SPENT
PICKLE
ACID
11
14
13
REGENERATED
PICKLE ACID
FILTRATE
MAKE UP
HF AND $HNO_3$
$CaF_2$
17
16
FILTER
FILTER
17
RECYCLE
TANK
18
19
$Na_2ZrF_6$
TO
DISPOSAL
$CaSO_4$

PROCESS OF PRECIPITATING ZIRCONIUM OR HAFNIUM FROM SPENT PICKLING SOLUTIONS

BACKGROUND OF THE INVENTION

1. Field:

The invention is in the field of chemical processing of a spent acid solution used for pickling a metal, in particular zirconium or hafnium.

2. Description of the Prior Art:

Zirconium and hafnium metals and alloys are normally conditioned, following production and before shipment to users, by a pickling procedure in a nitric acid bath containing a relatively small percentage of hydrofluoric acid. The spent pickle acid, saturated with zirconium or hafnium fluoride, is customarily sent to waste after being neutralized by the addition of lime.

Proposals have been made heretofore for alleged commercially useful regeneration of the spent pickle liquor for reuse in the pickling circuit and, in some instances, for the recovery of useful by-products.

Thus, in Megy et al., U.S. Pat. No. 4,105,469, the spent pickle liquor is regenerated by adding sodium fluoride (NaF), which, in the case of zirconium, precipitates sodium zirconium fluoride ($Na_2ZrF_6$) out of the solution. After hydrogen fluoride (HF) and nitric acid ($HNO_3$) are added to the residual solution to make up losses thereof, the regenerated solution is recycled for reuse in the pickling circuit. The precipitant by-product can be used in the making of zirconium-magnesium alloys or can be reduced to zirconium metal.

To like effect is Fennemann et al., U.S. Pat. No. 4,330,342, which teaches precipitation of $Na_2ZrF_6$ from a spent HF $HNO_3$ pickle liquor by the addition of dissolved sodium hydroxide (NaOH) to such liquor after heating thereof, precipitation of the $Na_2ZrF_6$ taking place after cooling of the so-treated liquor.

Pansom, U.S. Pat. No. 4,738,747, teaches how such a spent pickle liquor resulting from the etching of zirconium metal or an alloy thereof can be regenerated for reuse in the etching circuit by the addition of appropriate amounts of hydrofluoric acid and a nitric acid following measurements and calculations indicative of the correct amounts, this being accomplished without the previous removal of dissolved zirconium from the spent solution.

SUMMARY OF THE INVENTION

In accordance with the present invention, the normally waste pickle liquor is treated (for the recovery of a valuable commercial product and for the purification of the acid solution so that it can be recycled to the pickling tank) by the addition thereto of an effective amount of sodium sulfate, $Na_2SO_4$. This results in the precipitation of sodium zirconium or hafnium fluoride. Such solution can be purified and increased in fluoride concentration by the addition thereto of an effective amount of calcium fluoride. The sulfate ions are precipitated as calcium sulfate ($CaSO_4$).

Advantages of the process are that it is possible to recycle the residual nitric acid pickle solution after adding make-up amounts of hydrofluoric and nitric acids, so that the need for neutralization and disposal as waste are eliminated, and the amount of hydrofluoric acid necessary to spike the nitric acid in the recycled acid solution is significantly reduced.

THE DRAWING

The procedure presently contemplated as the best mode of carrying out the invention in practice is illustrated in the accompanying drawing in which the single FIGURE is a flowsheet having the usual pickle acid as the feed material.

DETAILED DESCRIPTION OF THE ILLUSTRATED EMBODIMENT

As illustrated, a series of pickle tanks 10, here shown as four, are supplied with the usual zirconium or hafnium metal pickling acid (40% nitric acid and 3% hydrofluoric acid) from any suitable source of same. In this instance, zirconium metal or an alloy thereof is treated within these tanks in the usual manner well known in the art and the pickle solution, when spent, i.e., saturated with zirconium fluoride, is transferred to a storage tank 11, as by means of pumps 12, from where it is passed to a regeneration tank 13, as by means of a pump 14. Sodium sulfate, advantageously as a granulated solid, is introduced into tank 13 and mixed with the spent acid solution, as by means of a power mixer 15.

Following precipitation of sodium hexafluoro zirconate in tank 13, both the precipitate and the residual acid solution are passed by a pump 16 into a series of filters 17 (here shown as two) from which the regenerated acid filtrate is passed to a recycle tank 18 and from there recirculated back into pickle tanks 10, as by means of a pump 19, following the introduction of calcium fluoride as a precipitant for calcium sulfate.

Precipitation of calcium sulfate from the residual pickle acid solution by the addition of calcium fluoride increases the fluoride concentration of the nitric acid, which is advantageous. However, it may be found desirable to add make-up amounts of hydrogen fluoride and nitric acid as indicated before recycling to the pickle tanks.

If there is a hafnium pickle circuit as well as a zirconium pickle circuit in the same plant, the spent solutions should be kept separate.

EXAMPLE

The process was carried out experimentally in the laboratory. A 25 milliliter aliquot of the usual plant pickle acid was placed in a 100 ml. beaker containing a magnetic stir bar. As the solution was agitated, 0.500 grams of $Na_2SO_4$ was sprinkled over the surface. After ten minutes, the solution was filtered using No. 40 quantitative filter paper and the filtrate analyzed for metalic impurities. The results were compared with results of a similar analysis of the untreated acid.

Using the analysis of the untreated acid, molar quantities of the zirconium and hafnium impurities were calculated. Based on this value, an equivalent quantity of $Na_2SO_4$ was added to 50 ml of pickle acid as it was being agitated in a second 100 ml beaker. After ten minutes the solution was filtered, the filtrate and precipitate being retained for ICP analysis. Experimental date was as follows:

| | | TREATED | |
|---|---|---|---|
| ANALYTE | UNTREATED | 25 ml. Pickle Acid 0.5 g $Na_2SO_4$ | 50 ml. Pickle Acid 0.300 g $Na_2SO_4$ |
| Hf | 200 ppm | 16 ppm | 110 ppm |

-continued

| ANALYTE | UNTREATED | TREATED 25 ml. Pickle Acid 0.5 g $Na_2SO_4$ | TREATED 50 ml. Pickle Acid 0.300 g $Na_2SO_4$ |
|---|---|---|---|
| Zr | 0.25% | 100 ppm | 0.13% |
| Al | 19 ppm | 6 ppm | 15 ppm |
| Fe | 137 ppm | 36 ppm | 30 ppm |
| $SO_4$ as S | 280 ppm | 1.4% | 0.4% |

Calculations were as follows:

Zr: 2500 ug/ml (50 ml) = $1.25 \times 10^5$ ug Zr $$\frac{1.25 \times 10^5 \text{ mg}}{91.2 \text{ ug/u mole}} = 1.37 \times 10^3 \text{ u mole Zr}$$

Hf = 200 ug/ml (50 ml) = $1 \times 10^4$ ug Hf $$\frac{1 \times 10^4 \text{ ug}}{178.5 \text{ ug/u mole}} = 56 \text{ u mole Hf}$$

Al = 19 ug/ml (50 ml) = 950 ug $$\frac{950 \text{ ug}}{27 \text{ ug/u mole}} = 35 \text{ u mole Al}$$

Total metal inpurites = $1.46 \times 10^3$ u moles in 50 m.

Need $1.46 \times 10^3$ u moles $Na_2SO_4$ for precipitation of metal impurities.

These experimental results indicate that recovery of spent pickle acid is possible by the addition of sodium sulfate, which precipitates a majority of the metal impurities. When an excess of sodium sulfate was added, as illustrated by the data, 92% of the Hf, 96% of the Zr, and 70% of the Al were removed. Upon addition of only 49% of the required amount of sodium sulfate for total metal precipitation, 48% of the Zr, 45% of the Hf and 21% of the Al was removed. The sulfur value was indicative of an incomplete reaction, which was not unexpected due to the limited reaction time (10 minutes). There should be minimal impact upon the reactivity of the pickle acid ($Ka_2 = 1.2 \times 10^{-2}$ for sulfuric acid) and, therefore, it can be utilized immediately upon filtration of the precipitate.

Adding sodium sulfate to a warm solution would increase the solubility of the salt, and a subsequent cooling of the solution would promote precipitate formation.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim as our invention:

1. A process for regenerating a spent, fluoride-containing, pickle solution used in the pickling of zirconium or hafnium metal or their alloys, comprising adding to the spent pickle solution a sufficient amount of sodium sulfate to precipitate sodium zirconium or hafnium fluoride.

2. A process according to claim 1, wherein a sufficient quantity of calcium fluoride is added to the spent pickle solution to precipitate calcium sulfate therefrom, thereby increasing the fluoride concentration of said pickle solution.

3. A process according to claim 2, wherein the spent solution is recycled to zirconium or hafnium pickling.

4. A process according to claim 1, wherein the spent solution is recycled to zirconium or hafnium pickling.

* * * * *